US005707457A

United States Patent [19]

Yates

[11] Patent Number: 5,707,457

[45] Date of Patent: Jan. 13, 1998

[54] APPARATUS AND PROCESS FOR SPRAY RINSING CHEMICALLY TREATED ARTICLES

[76] Inventor: William Yates, P.O. Box 90068, Henderson, Nev. 89015

[21] Appl. No.: 584,283

[22] Filed: Jan. 11, 1996

[51] Int. Cl.[6] ..... B08B 3/02

[52] U.S. Cl. ..... 134/30; 134/95.3; 134/95.1; 134/98.1; 134/103.1

[58] Field of Search ..... 134/26, 30, 94.1, 134/95.1, 95.2, 95.3, 98.1, 102.1, 102.2, 102.3, 103.1

[56] References Cited

U.S. PATENT DOCUMENTS

| | | | |
|---|---|---|---|
| 2,558,628 | 6/1951 | Redin | 134/95.3 |
| 3,140,828 | 7/1964 | Galanor | 134/103.1 |
| 3,435,834 | 4/1969 | Cooper | 134/98.1 |
| 3,690,333 | 9/1972 | Kiemer | 134/95.1 |
| 3,945,388 | 3/1976 | Clark | 134/103.1 |
| 4,059,123 | 11/1977 | Bartos et al. | 134/102.2 |
| 4,141,312 | 2/1979 | Louder et al. | 134/103.1 |
| 4,917,123 | 4/1990 | McConnell et al. | 134/98.1 |
| 5,063,949 | 11/1991 | Yates | 134/98.1 |
| 5,139,039 | 8/1992 | Yates | 134/95.1 |
| 5,361,790 | 11/1994 | Park et al. | 134/95.3 |
| 5,507,305 | 4/1996 | Franklin | 134/94.1 |

*Primary Examiner*—Frankie L. Stinson
*Attorney, Agent, or Firm*—Francis X. LoJacono

[57] ABSTRACT

An improved apparatus and process for spray-rinsing chemically treated articles or workpieces with a multi-spray counterflow rinse system wherein the rinsing of chemically treated or otherwise processed workpieces are either supported or suspended by a support carrier which is defined by an article support rack or by a perforated process barrel in which the articles or workpieces are supported therein, and wherein the rack and the barrel include an internal spray assembly that is removably coupled to the rinse tank spray assembly when either the rack or barrel are positioned within the rinse tank, and whereby a fresh uncontaminated rinse solution, preferably fresh water, is pressurized when entering the rinse tank spray assembly. The pressurized fresh water also defines a means to purge the rinse tank spray assembly after completion of each rinse cycle.

23 Claims, 5 Drawing Sheets

APPARATUS AND PROCESS FOR SPRAY RINSING CHEMICALLY TREATED ARTICLES

BACKGROUND OF THE INVENTION

1. Field of the Invention

The present invention relates generally to an improved apparatus and process for rinsing chemically treated articles or workpieces with a multi-spray counterflow rinse system wherein the rinsing of chemically treated or otherwise processed workpieces are either supported by a suspended rack or carried within a perforated process barrel having an internal spray means and wherein a pressurized air flow is employed along with fresh uncontaminated rinse solution preferably fresh water.

2. Description of the Prior Art

There are many problems and difficulties that are still encountered in providing suitable and efficient water-rinsing means for rinsing or cleaning of chemically treated articles or workpieces, and each of the many types of rinsing operations has its own unique problems. For example, various problems occur during rinsing operations when a large single workpiece or several workpieces are of a size and configuration that require them to be supported by a support rack. Another problem is found in the rinsing of chemically treated articles or workpieces that are stored in a rotatable processing barrel.

Rinsing of workpieces is generally required after they have been chemically or similarly treated by one of several processes requiring the pieces to be cleaned of contamination to prevent staining or to prevent the contamination of sequential processes that might be required. Rinsing is generally done by placing the rack with the workpiece or the barrel with treated articles in a tank of water or rinse solution or sequentially dipping the articles in several cleaning tanks.

Rinsing removes most of the chemicals from processed workpieces by diluting the contamination with water, generally referred to as "carryover" or "dragout", from the process tank. This is usually done by immersing the workpieces in a tank that is flooded with water. In the case of barrel plating or processing, the barrel and its workpieces are submerged in one or more flooded rinse tanks. In a few rare cases, the work contained in a barrel is rinsed by flooding or spraying after the workpieces or articles have been dumped onto a suitable table.

For a single workpiece or a barrel of plated or processed parts being immersed in a flooded tank of clean water, the rinse ratio can be expressed as DO+RW/DO where DO is dragout and RW is rinsewater in the same units.

For example: If a barrel carries over one liter of process solution (dragout) into a rinse tank holding 1000 liters, the rinse ratio (or dilution) is 1001:1. Of 1001 liters in the rinse tank, one liter is process solution, or dragout. If there are other identical succeeding tanks, the rinse ratio (or dilution) multiplies This can be expressed as $$\left(\frac{DO+RW}{DO}\right)^{r}$$

where "r" is the number of identical rinses. All of this is possible when we have rinsed one load of work. Subsequent loads being rinsed are subjected to rinse water with greater concentrations of dragout and will end up with lower rinse ratios.

In a dynamic situation, where a production line brings in a quantity of dragout each hour and water is overflowed from each tank at a constant rate, then the above formulas will apply if we treat dragout and rinsewater as flow rates rather than discrete quantities. In the dynamic situation, we can usually ignore the size of the immersion rinse tank, and consider only the flow rates. It is true that the larger rinse tank will take longer to reach a given contamination level, but it will eventually reach this same "equilibrium" level.

Looking at multiple overflowing rinses where the formula $$\left(\frac{DO+RW}{DO}\right)^{r}$$

is applied, one will realize an enormous water savings because of the multiplication of rinse ratios from each tank. For example: using three rinses that each use 10 liters of water per hour (a total of 30 liters per hour) will dilute the dragout of one liter per hour to 1331:1 (11:×11.1×11:1). Had the same 30 liters per hour been overflowed from a single rinse, the rinse ratio would be 31:1.

Further, if the three tanks, in the example above, are arranged so that the 10 liters per hour flowing to the last rinse tank overflows to the second, and from there to the first, we achieve almost the same rinse ratio, 1111:1, as we did before, when using 30 liters per hour. Even though we are using 10 liters per hour in each tank, the one stream of water is getting progressively more contaminated on its way to the first rinse tank. Because of the progressive contamination, the formula to figure rinse ratios here is $$\text{Rinse Ratio} = \frac{\left(\frac{RW}{DO}\right)^{r+1} - 1}{\frac{RW}{DO} - 1}$$

where RW/DO is greater than 1.

Since the desired rinse ratios in plating shops are 2000:1 and up to 5000:1, these counterflowing techniques (above) are used extensively to reduce rinse water requirements. The term "counterflow" refers to the fact that water flows opposite, or counter, to the work flow.

Until recently, about the only method used for barrel rinsing was by immersion using one or more tanks, connected to counterflow the water.

U.S. Pat. Nos. 5,063,949 and 5,139,039 both issued to the present inventor, William Yates, describe "off-line" counterflow producing equipment that rinses individual rack mounted workpieces. A more recently issued U.S. Pat. No. 5,139,039, also issued to William Yates, introduced a method of spraying the articles and workpieces contained in a process barrel with an off-line device, known as the RinseMaster®, manufactured by Poly Products Corporation, which produces seven counterflowing rinse sprays. These sprays dilute 1 liter of dragout by 5000:1using only 3.2 liters of water. The RinseMaster® automatically connects to the special barrel when it is put into a single, empty spray tank. So little water is used that most or all can be returned to the process tank to compensate for surface evaporation.

However, the present application will hereinafter disclose another method of rinsing workpieces in a process barrel. In this arrangement, a fresh stream of uncontaminated water is sprayed into the barrel using the same spray bar and connecting device that are disclosed in U.S. Pat. No. 5,139,039. One may assume that it would take an enormous amount of water to achieve a 5000:1 rinse ration when rinsing a barrel containing 1 liter of dragout. However, a careful look at this process will show that a small amount of water can produce a larger than expected rinse ratio.

A process using an electroplating barrel has an additional problem of retaining excess dragout solution. These barrels are usually filled to about ⅓ capacity so that the work can tumble freely as the barrel is rotated in or out of the solution. When the barrel is removed from a process tank, capillary attraction and adhesion cause some of the process solution to be removed to the following tank. This "dragout" can be quite high in barrel processing due to the capillary attraction of the barrel's perforations and the minute spaces between small parts. It is not unusual to measure 1 liter of dragout in a 36" long barrel.

To better understand how a spray can be more effective than an immersion rinse, it is important that one realizes that a barrel that is saturated with dragout cannot hold any more solution, and that a 1 liter spray can be seen as 1000 separate, 1 gram additions of water to the total dragout capacity. If a barrel saturated with dragout is placed in an empty rinse tank, and one gram of water is sprayed across the top of the work mass, then one gram of almost undiluted dragout will drip off the bottom of the barrel. Each of the succeeding grams of water that are sprayed will result in additional runoff of progressively more diluted dragout. After finally spraying one liter of water on the work holding one liter of dragout, the liter of diluted dragout remaining on the work should be about 37% of the original concentration. This can be shown by the following:

$$\text{Rinse Ratio} = \frac{DO + RW^n}{DO}$$

where "n" is the number of spray applications of RW. In the example above, a barrel was sprayed holding 1 liter of dragout 1000 times using 1 gram of water each time. This can be shown as:

$$\text{Rinse Ratio} = \left(\frac{1+0.001}{1}\right)^{1000} = 2.72.$$

From this one can conclude that one liter of water spray will dilute one liter of dragout by 2.72:1. Now we can say that the rinse ratio of a spray can be expressed as: Rinse Ratio=$(2.72)^v$ where "v" is the number of volumes of water where dragout is one volume. When 8.5 liters of water is sprayed on a work load holding one liter of dragout the rinse ration is $(2.72)^{8.5}$ or 4941:1.

The following is a comparison of rinsing methods and water usage when rinsing one liter of dragout in a barrel to a 5000:1 rinse ratio:

In a single immersion rinse=4,999 liters.

In a single running rinse=4,999 liters per barrel.

In 4 running rinses=7.4 liters per rinse, 29.6 total.

In 4 counterflowing rinses=8.2 liters per barrel.

Using a 7 station RinseMaster®=3.2 liters per barrel.

Spraying all fresh water=8.5 liters per barrel.

As stated earlier, almost all barrel processing utilizes counterflowing immersion rinse tanks, usually two, sometimes three tanks. These would have to use 71 and 17 liters per barrel respectively, to get the results stated earlier. Using the barrel adapted for spray rinsing cuts this water usage to 3.2 liters by using the RinseMaster® process or 8.5 liters, using fresh water only per barrel. And, as an added benefit, the spray barrel uses only one empty spray station. This reduces the number of station transfers by manual or mechanical means, and it reduces the length of the processing line by about 50%.

SUMMARY AND OBJECTS OF THE INVENTION

Accordingly, it is an object of the present invention to provide a method and apparatus for multiple counterflow spray rinsing of processed workpieces that are either supported by a rack or a multiplicity of processed workpieces or articles that are supported within a plating barrel, wherein the rack or barrel along with their respective workpieces are removably positioned in a single multirinse station (tank), and wherein the spray-rinse operation includes a novel pressurized purge system whereby air is continuously provided throughout the rinse cycles and to further provide a continuous pressurized flow of fresh rinse water as needed.

Another object of the invention is to also provide air pressure to purge the solution within the spray lines between the manifold and the rinse tank. That is, compressed air is injected into the spray tubing downstream from the flow meter to evacuate as much of the contaminated or fresh water as possible from the spray lines around the rinse tank and from the spray device mounted within the barrel when the barrel is connected to the coupling bracket mounted in the rinse tank.

Yet another object of the invention is to provide an apparatus and a process that rinses chemically or otherwise treated articles within a single rinse tank or station using the counterflowing principle having multiple pressurized tanks for spraying the articles with progressively cleaner (less contaminated) rinse water, including a final pressurized fresh water spray cycle, without moving the workpiece or the barrel that supports a large number of treated articles from one rinse tank to another.

A further object of the present invention is to provide a process of this character that includes the use of constant air pressure to provide "push air" to purge the rinse water flow lines and to also provide a continuous even spray of fresh water (uncontaminated rinse solution) on all contaminated workpieces and/or articles and wherein a minimal amount of fresh rinse water is used.

A still further object of the present invention is to provide a process and apparatus that can be adapted to operate for a particular counterflow rinse system wherein one or more reservoirs may be employed having a single pump-return operation that provides a means to return rinse water from each reservoir under pressure to the respective sealed tank, whereby the rinse solution in each tank is pressurized. The pressurization in each reservoir provides enough constant pressure to send each respective counterflow of rinse solution back to the spray tank under its own pressure, thereby eliminating the need of a second pump, and wherein each given number of reservoirs used will provide a given number of pressurized counterflow spray cycles. The ratio of counterflow spray rinse cycles is determined by the number of reservoirs times two plus one.

One reservoir=3 counterflow spray cycles

Two reservoirs=5 counterflow spray cycles

Three reservoirs=7 counterflow spray cycles

Each of the above cycles ends with a pressurized fresh uncontaminated rinse solution (fresh water) rinse cycle.

A still further object of the present invention is to provide a process and apparatus that allows any of the 3, 5 and 7 counterflow spray cycles to be converted to a continuous single spray cycle of fresh water that is sprayed over the workpieces or articles under pressure. This operation can be used as a backup in case of any failure involving any one or all of the regular spray cycles. The fresh-water-only operation can achieve a 5000:1 rinse ratio using only 8.6 units of water, which is equivalent to a four-counterflow-rinse system.

Still another object of the present invention is to provide a process and apparatus using pressurized reservoirs, whereby each reservoir and its spray valve can be extended by individual hoses to a remote manifold located adjacent the spray nozzles mounted on the rinse tank. This means that very little water or spray solution is held in the common tubing beyond the remote manifold. This reduces the time and quantity of "fresh" water or purging solution or air.

It is still another object of the invention to provide an apparatus and process of this character to accomplish the rinse spraying of treated articles in a single rinse tank or station, the rinse solution being pumped and recirculated under its on pressure from off-line sealed reservoirs for a predetermined time in overlapping sequences from one sealed reservoir to another. The cycles of the process provide a rinse solution that is under continual and constant air pressure, wherein at least the last cycle ends with a flow of pressurized fresh water, whereby compressed air is injected into the spray tubing downstream from the flow meter to evacuate all the contaminated or a fresh uncontaminated rinse solution possible from the spray lines and spray heads around the rinse tank. This process is compatible with the rinsing of a single workpiece or a multiplicity of workpieces or articles that are supported in a perforated, rotatable barrel for bulk processing.

A still further object of the present invention is to provide a process of this character that will produce a clean workpiece with the smallest amount of fresh water possible.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
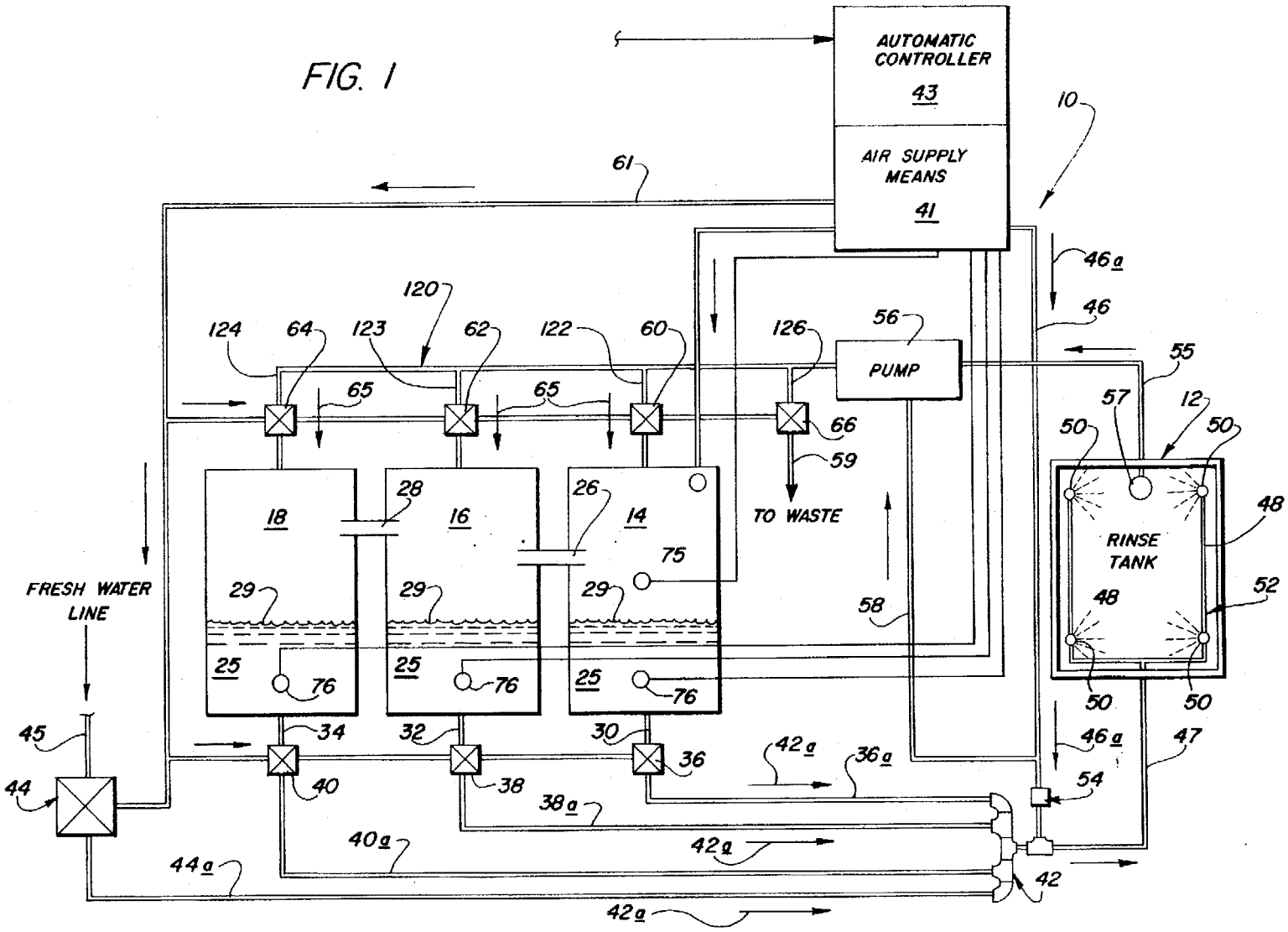
FIG. 1 is a diagrammatic view of the operating counterflow rinse system that includes three reservoirs and a single off-line rinse tank adapted for rinsing articles supported by a rack.

Referring more particularly to FIG. 1, there is illustrated a new and improved multi-counterflow rinsing apparatus, generally indicated at 10, that includes an improved method of a fluid-circulating system for cleaning the surfaces of chemically treated articles and/or workpieces either singularly supported on racks or for cleaning a multiplicity of articles supported within a plating barrel, generally indicated at 13 in FIG. 3, which will hereinafter by described in more detail.

Although, three reservoirs, also referred to tanks, are shown and described herein it should be noted that any number of reservoirs may be suitably employed so as to correspond to a particular counterflow rinse system. That is, several reservoirs can be added or subtracted as might be required.

Accordingly, the following description of the present invention will hereinafter describe several embodiments using three sealed reservoirs 14, 16 and 18 in which rinse water (also defined as rinse solution) 25 is stored and ready for operation as part of the process of the present invention. Each reservoir is provided with different strengths of rinse solution 25. Thus, each successive reservoir 14, 16 and 18 holds progressively cleaner or less contaminated rinse solution 25.

Due to the sequential arrangement of the reservoirs and steps of the process, the degree of contamination of the rinse solution in each reservoir will remain substantially the same throughout the rinsing operation. Preferably, in order to save space, reservoirs or tanks 14, 16 and 18 are positioned in a contiguous arrangement whereby reservoir 18 communicates with reservoir 16, and reservoir 16 communicates with reservoir 14 by overflow means such as indicated by passage or pipe 26 that communicates between reservoirs 14 and 16, and passage or pipe 28 that provides communication between reservoirs 16 and 18, as illustrated in FIG. 1. Pipe 26 is positioned lower than pipe 28 with both pipes being located above operating waterline 29 of the reservoirs. This allows for diluted rinse solutions or water to flow from each succeeding reservoir as might be needed when any reservoir is accidentally overfilled. Accordingly, the most diluted rinse solution is stored in reservoir 18, and the most contaminated rinse solution is stored in reservoir 14.

Each reservoir or tank is provided with a discharge-flow outlet pipe; that is, reservoir 14 is provided with discharge pipe 30, reservoir 16 with discharge pipe 32, and reservoir 18 is provided with discharge pipe 34. Pipes 30, 32 and 34 are each connected to a respective valve means 36, 38 and 40. The valve means may be of any suitable type, but is preferably a pneumatically operated one such as a double-acting pneumatic valve. Valve means 36, 38 and 40 will hereinafter be referred to as discharge valves since they are positioned between their respective discharge pipes or hoses **36*a*, 38*a* and 40*a* and inlet ports of a discharge manifold, generally designated at 42. Note flow direction of arrows 42*a* are in the direction of manifold 42. It should be noted that for best results in this system manifold 42 should be located as close as possible to rinse tank 12, which is diagrammatically shown adapted to receive various types of rack supporting means on which a single or a plurality of single articles are hung or otherwise supported. The present invention is adapted to operate with various types of rinse tanks such as the barrel rinse tank 12*a* illustrated in FIGS. 2 and 3. A fourth valve 44 is connected to manifold 42 along with discharge valves 36, 38 and 40. Valve 44 which is a fresh-water valve and is connected to any suitable fresh water line 45 is operated by air pressure supplied from air supply means 41**.

An air line 46 is connected at one end to an air-supply means 41 located within an automatic controller unit, indicated at 43, and at the opposite end to the outlet side of manifold 42, in the direction of arrow 46*a*, whereby air line 46 is connected downstream of the manifold to inlet spray line 47 positioned between the manifold and the rinse tank. At this location compressed air, having at least 15 lbs. of pressure, is used to purge all rinse solutions including the fresh water flow as it leaves manifold 42. The air pressure occurs automatically to purge the system during each of the pauses between the spray rinse to complete the delivery of spray solution or water that would otherwise be left in delivery pipe 47, spray hoses 48, and nozzles 50. This provides an efficient means by which, at the end of each spray rinse cycle, the rinse solution or water is completely purged with a the continuous flow of air through the discharge line 47, out from the rinse spray means and into rinse tank 12, indicated generally at 52.

Pump 56 is also operated by air which is provided by air line 58 that originates at air-supply means 41. Proper purging using compressed air increases the efficiency of the seven counterflow systems. Any rinse water left in the delivery hoses and piping downstream from the manifold will be seen as dragout volume, thus decreasing rinse efficiency.

Accordingly, solution 29 is drained into a return flow system which includes an outlet or drain pipe 55 that is connected from outlet 57 of rinse tank 12 to pump 56, whereby the rinse solution is returned sequentially to respective reservoirs 14, 16 and 18 by means of pump 56 which is connected to the respective return pneumatic valves 60, 62, 64 by means of an air conduit circuit 61, as indicated by arrows 65, or to waste return valve 66 which discharges waste rinse solutions through waste line 59.

Figure 2:
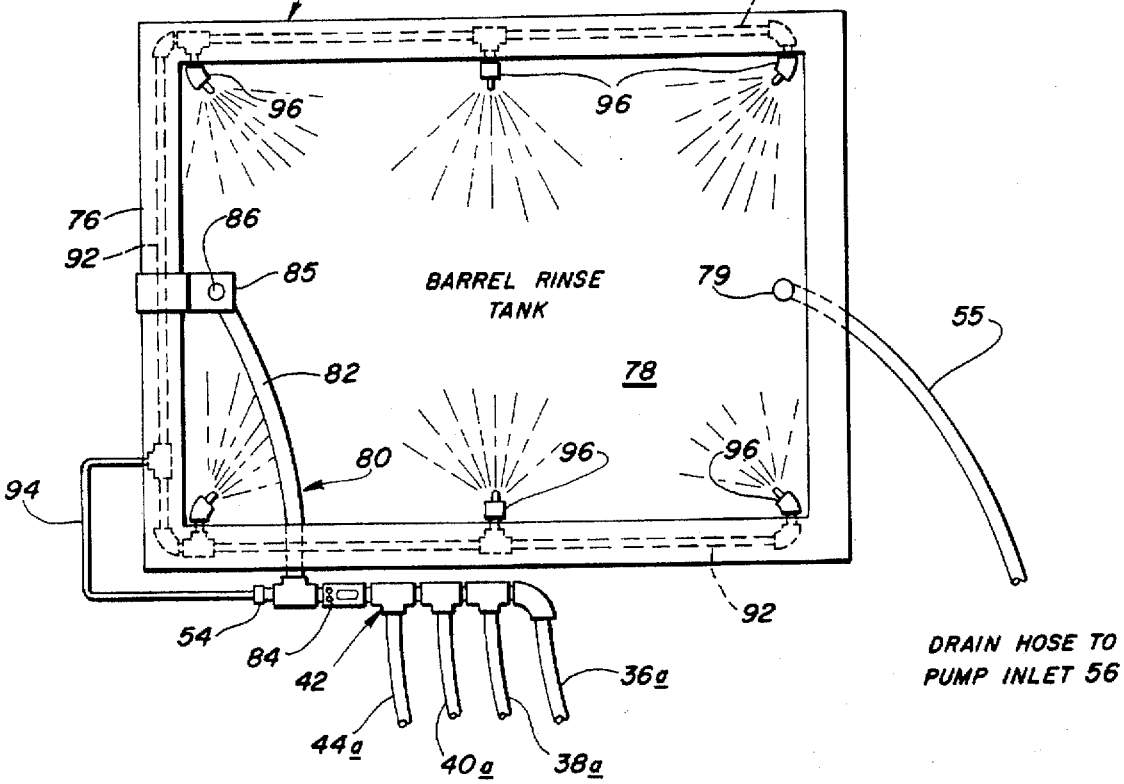
FIG. 2 is a diagrammatic top plan view of a barrel rinse tank adapted to by used in combination with the counterflow rinse system as illustrated in FIG. 1.
Figure 3:
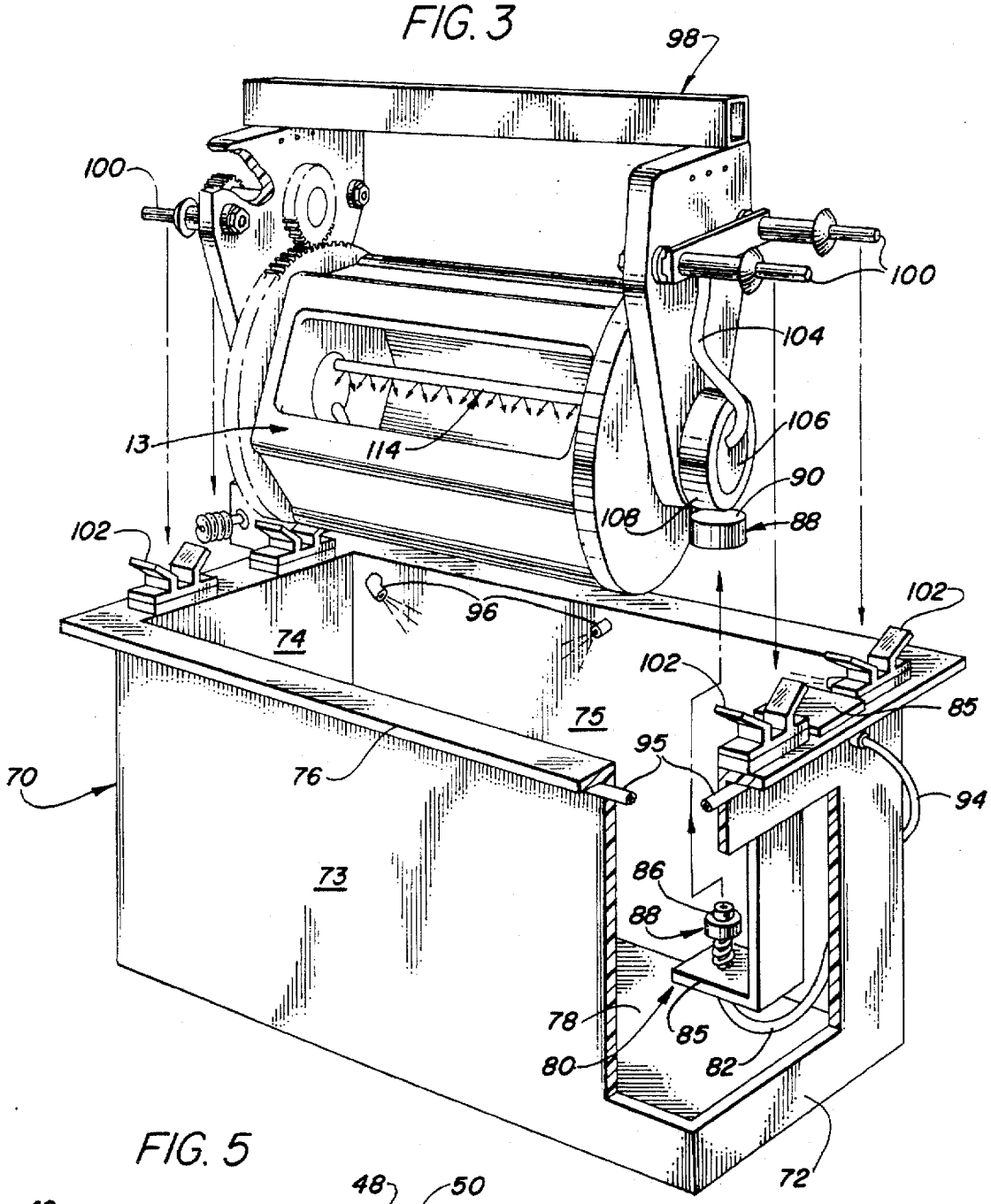
FIG. 3 is an exploded pictorial view of a barrel rinse tank with a portion thereof broken away, and the rinse barrel and its superstructure being lowered into the rinse tank.

A second embodiment of the invention is defined by replacing the rack-type rinse tank 12 with a barrel rinse tank, indicated generally at 70 and illustrated in FIGS. 2 and 3. The barrel rinse tank 70 is adapted to be connected to the multi-counterflow rinse system, as shown in FIG. 1, and is arranged to receive a bulk spray-rinse carrier that is defined by plating barrel 13 or by a spray-rack device 120, which is described hereinafter as a third embodiment, for rinsing a multiplicity of articles or small workpieces while the articles are stored in the plating barrel.

Rinse tank 70 is formed having side walls 72, 73, 74 and 75 each of which is provided with an outwardly extended flange 76 and an inclined or diverging tank floor 78. Within floor 78 is located a drain outlet 79 to which is connected a drain pipe or hose 55 that extends therefrom to connect with pump 56.

The spray rinsing means, indicated generally at 80, includes delivery pipe 82 that is connected between a flow gauge 84 attached to manifold 42. In this arrangement, manifold 42 is mounted to wall 75 of tank 70 or as close to tank 70 as possible. This will allow for a very short length of delivery pipe 82 to be attached to an internally mounted coupling bracket 85. A first coupling member 86 is mounted to bracket 85 and defines part of a coupling means 88, wherein a second coupling member 90 is mounted to the side of the barrel.

When coupling members 86 and 90 are connected at the same time, barrel 13 is positioned within the rinse tank 70. Spray hoses or conduit lines 92 are positioned around the rinse tank under flange 76 and are attached to rinse solution inlet line 94. A plurality of spray nozzles 96 are connected to the conduit lines 92 and extend within the rinse tank 70, as illustrated in FIGS. 2 and 3.

The supporting frame structure of the barrel, indicated at 98, is commonly provided with support pins or lugs 100 that rest in cradle members 102. Pins 100 also make up part of the electrical system necessary to provide electric power for an electroplating treatment which is performed at selected work stations. Two electrical cables 104 are connected to each set of lugs 100 and are arranged to enter hub means 106 so as to extend within barrel 13 to define internal electrodes 105. The hub means is rotatably supported in a bearing means 108, which is part of structure 98, and is formed with an annular channel 110.

Accordingly, coupling member 90 is attached to bearing means 108 so as to communicate with channel 110. The two coupling members 86 and 90 are connected, and as the barrel is lowered into the rinse tank 73, the rinse solution or water will flow from hose 82 through coupling means 88 into channel 110 and discharged through passage 112.

Passage 112 is adapted to receive an internal spray means, generally designated at 114. There are two suitable types of internal spray means that may be employed in barrel 13, and this is generally determined by the size and configuration of the workpiece that is to be rinsed since the barrel is normally rotated about its axis during each rinse cycle. In FIG. 3 the spray means is illustrated as an elongated spray pipe 114 that extends across the barrel from one side to the other.

Figure 4:
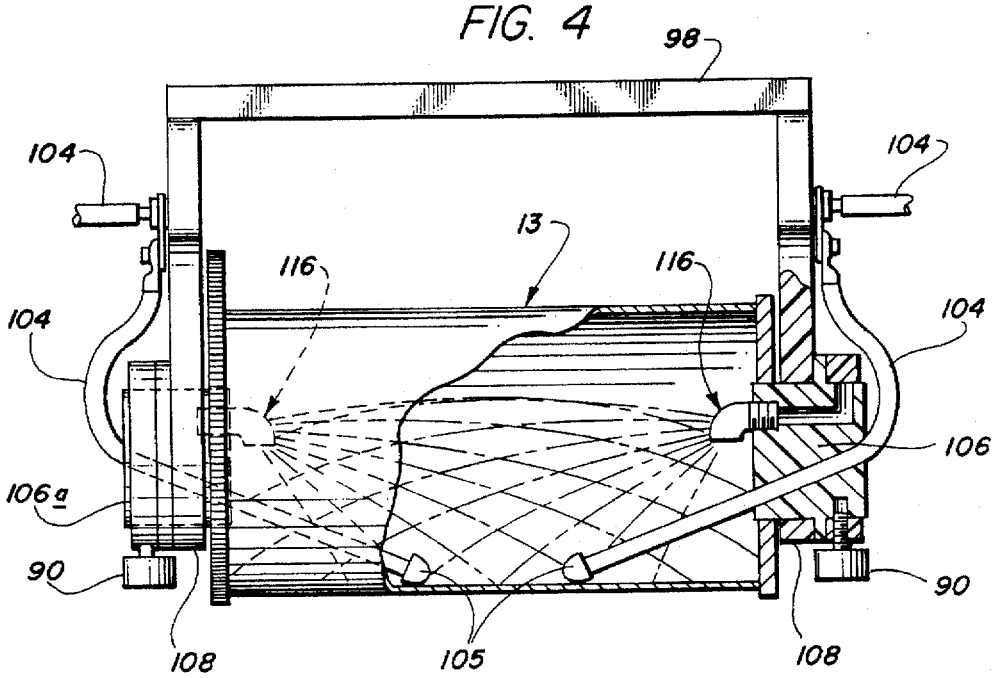
FIG. 4 is a side elevational view of a rinse barrel having a portion thereof broken away showing an alternative arrangement of a spraying means.

The other type of a barrel spray rinse means, shown in FIG. 4, comprises two spray heads 116 which are removably mounted in passage 112 of two oppositely disposed hub means 106 and 106*a*. With both spray heads 116 a free flow of rinse solution is injected into the interior of the barrel so as to cover the entire lower half of the barrel.

Figure 7:
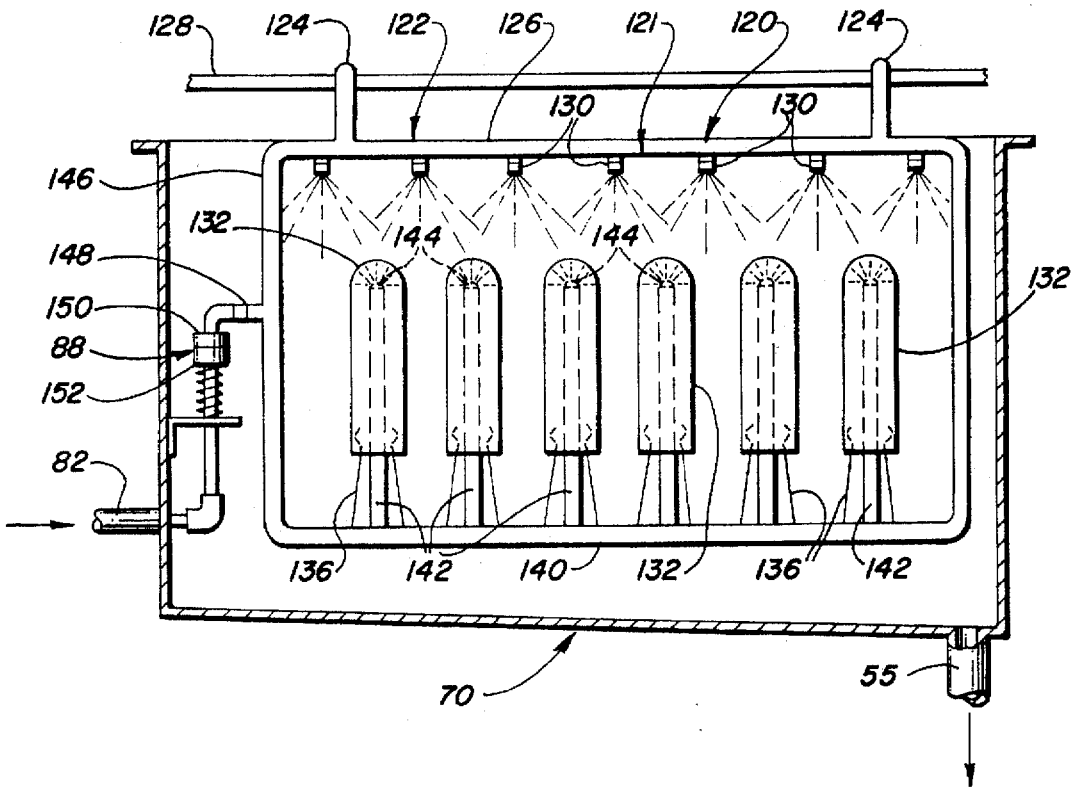
FIG. 7 is a schematic cross-sectional view of a barrel-type rinse tank, showing a spray rack holding a plurality of articles thereon for spray rinsing.

In FIG. 7 there is illustrated a third embodiment of the present invention which employs a multi-article spray-rack device 120, wherein the barrel rinse tank 70 or a suitable like tank includes a coupling means 88 adapted for use in conjunction with the spray rack, which comprises a frame structure having a suitable configuration, herein shown as an elongated rectangular tubular frame 122 having hangers 124 affixed to the upper tubular section 126 so as to be removably attached to a carrier means 128.

The upper tubular section is also provided with internal spray means defined by a plurality of spray heads 130 that are arranged to spray downwardly so as to cover articles 132 shown supported by article mounting means 134 that are defined as spring clips 136 attached to the lower tubular section 140 of frame 122. Riser members 142 are mounted to the lower tubular section 140 and communicate with a flow passage defined within tubular frame 122. Each riser includes a spray head 144, whereby the interior surfaces of the article 132 is amply rinsed.

Thus, it can be seen that various tubular or cylindrical articles having various configurations may be readily cleaned as well. One of the side members 146 is provided with an extension arm 148 to which is attached a first coupling member 150 removably coupled to a second coupling member 152 that is operably mounted to bracket 154. Accordingly, the incoming flow of rinse water or solution enters through hose 82 as previously described with respect to the barrel rinsing operation.

A second arrangement of the third embodiment also comprises a multi-spray article-support means 120 that is adapted for use with the barrel rinse tank 70 which includes a coupling means 88 adapted for use in conjunction with a spray rack device, generally indicated at 121, which comprises a rectangular frame 160 having hangers 162 affixed to the upper frame section 164 so as to be removably attached to a carrier means 128.

Article mounting means 165 are attached on the lower frame section 166 and are defined as spring clips 168. Riser members 170 are mounted to a plastic tubular manifold 172 that is connected with a flow pipe 174. The riser members are attached to the lower frame section 166 over which articles 132 are positioned. The rinse solution will enter through hose 82 by way of coupling means 88 through flow pipe 174 and manifold 172. Each riser includes a spray head 176, whereby the interior surfaces of the articles 132 suitably rinsed. It should be noted that rinse tank 70 could include spray heads positioned about the interior of the tank, as previously described above.

OPERATION OF THE COUNTERFLOW PROCESS

Figure 5:
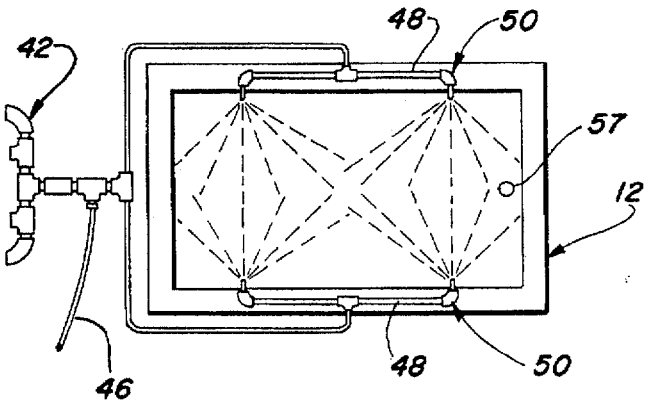
FIG. 5 is a diagrammatic top plan view of the rinse tank that is adapted to receive rack supported articles when used in combination with the counterflow rinse system as illustrated in FIG. 1.

The following description of the present invention discloses the employment of a three-reservoir counterflow-spray system having seven rinse cycles employing a rack-type rinse tank, as shown in FIG. 1 and 5. Further, it should be understood that the present process can be readily practiced with any number of reservoirs that would be compatible with the particular process requirements as heretofore described.

Figure 6:
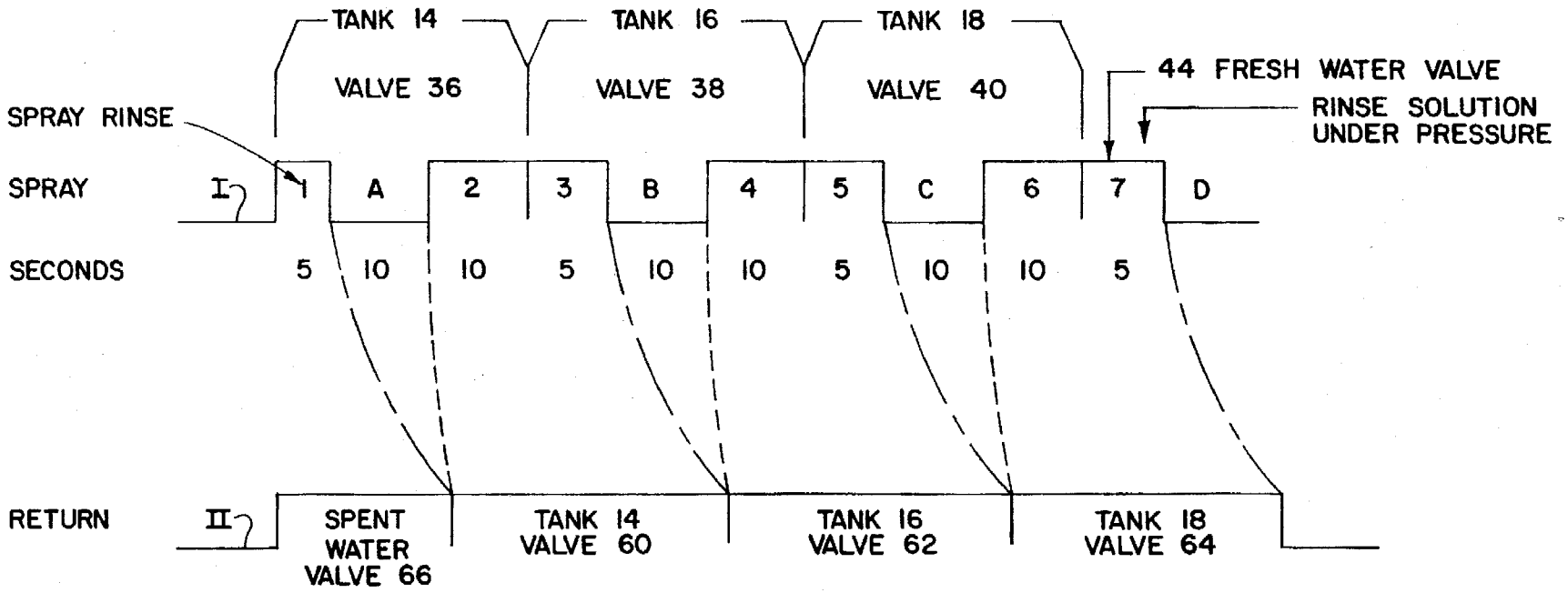
FIG. 6 is an operational chart of the pump and valve programming of the sequential circulating counterflow system.

FIGS. 1 and 6 may be referred to during the reading of the following operational description. The valve operational chart of FIG. 6 includes an upper line "I" indication for the spray operation of valves 36, 38, 40 and 44. The lower second line "II" indicates the rinse water return operation. The upper line includes "on" and "off" timing switches of valves 36, 38, 40 and fresh water valve 44, wherein all valves are pneumatically operated by air supply means 41.

Each time a rinsing process begins, a first (1) spray-rinse cycle starts with at least a one-second delay followed by rinse solution 29 from sealed reservoir or tank 14 being sprayed for approximately five seconds by way of outlet pipe **36*a*. The rinse solution in tank 14, which is sprayed first, has the highest contamination of all the solutions stored within the three sealed tanks. This first rinse solution, which is generally contaminated water, is discharged under pressure by means of air pressure that is built up or captured within the sealed tank as valve 36** is opened.

The pressurized solution 29 passes through pipe or a suitable conduit **36*a* and is sent through manifold 42, whereby the solution is routed to a spray-means assembly 52 which includes lines 47 and 48, and a plurality of spray nozzles 50 operably mounted to lines 48. These spray nozzles are arranged to spray within a rinse tank structure such as 12, whereby the rinse solution is sprayed directly over the workpieces located within the rinse tank. At the time the first cycle is started, air is continuously pumped from air supply means 43 through hose line or pipe 46 in the direction of arrow 46*a* and passes through an air adjusting means 54 into line 47** under at least 15 lbs of pressure.

Solution from rinse tank 14 is drained during pause cycle A (See FIG. 6) and is sucked through drain hose 55, whereby all solution downstream of manifold 42 is purged into the rinse tank and returned to operating pump 56 during a 10 to 15 second pause cycle. This first pause cycle is programmed as is all pause cycles to insure that most of the contaminated spray water is collected and pumped by pump 56 through a manifold 120 which is schematically shown in FIG. 1 as inlet conduits 122, 123, 124, 125 and 126 connected to the respective pneumatic valves 60, 62, 64 and waste valve 66.

Thus, the first pause cycle sends any leftover contaminated spent solution through the opened waste valve 66, and to a waste deposit or station or back to an assigned process tank, not shown. At this time all other valves are in a closed mode. The spent solution will contain almost all of the residue rinsed off the processed workpiece or workpieces; thus the first spray is generally highly contaminated and for this reason is sent to waste.

Drain cycle A occurs between the first (1) spray rinse and the second (2) spray rinses; between the third (3) and fourth (4) spray rinses; and between the fifth (5) and sixth (6) spray rinses. These drain cycles are referred to as a fifteen-second pause times (See chart of FIG. 6 at A, B, and C.).

A second spray-rinse cycle begins at (2) and sprays the workpiece positioned in the rinse tank again. This time waste valve 66 is closed and valves 36 and 60 are now opened, allowing solution 29 from sealed reservoir 14 to flow under pressure to manifold 42 by way of line **36*a*, whereby the solution exits manifold 42 and is again pressurized by the constant air flowing from air supply means 41, whereby the workpiece is spray rinsed a second time for approximately 10 to 15 seconds, as indicated in FIG. 6. The second spray rinse from tank 14 is returned to tank 14**.

Then valve 36 is closed to start the third (3) spray rinse cycle with valve 38 being opened for a selected time period together with return valve 60. This allows rinse solution from sealed tank 16 to return to sealed tank 14 under the same pressurized conditions as the first and second counterflow cycles. Valve 38 is then closed down during a second pause cycle so as to insure that all the solution in the spray lines connected to the rinse tank is returned to tank 14.

This is followed by a fourth (4) spray-rinse cycle, whereby solution from sealed tank 16 is discharged through reopened valve 38 to spray rinse the workpiece in rinse tank 12 for a selected time period, approximately 10 to 15 seconds, so that solution from tank 16 can be returned to tank 16 through return valve 64.

Spray-rinse cycle five (5) is a counterflow spray where solution from sealed tank or reservoir 18 is returned to tank 16. That is, valve 38 is closed and valve 40 is then opened for approximately 10 to 15 seconds, allowing a much less contaminated solution from tank 18 to be released and returned through rinse tank 12, as previously described above, so as to return to sealed tank 16. There is a third pause of fifteen seconds so as to again allow any remaining inline solution to be purged by the continuous air pressure generated by air supply means 41 that enters downstream of manifold 42. Valve 40 is then closed for a third drain cycle C, whereby all inline contaminate solution is purged into tank 16.

A sixth (6) spray-rinse cycle is started when discharge valve 40 is reopened along with the closing of inlet valve 62 and the opening of inlet valve 64 connected to tank 18. Accordingly, solution from tank or reservoir 18 is recycled back to reservoir 18.

This is followed by the final seventh (7) rinse cycle which comprises a flow of fresh water from the fresh water supply, whereby fresh water valve 44 is opened, allowing fresh water to flow into inlet pipe **44*a* through manifold 42 so as to provide a clean spray of purely fresh water to cover the workpiece or workpieces in a final rinse. The quantity of the fresh water spray should be at least equal to the counterflow sprays of 1, 3 or 5. Since the last rinse cycle is purely a fresh water spray there is no need to purge the lines downstream of manifold 42**. This allows the following counterflow operation for treating a chemically contaminated workpiece or workpieces to start with a short spray of fresh water.

The second embodiment of the present invention comprises the employment of the above-described multi-spray counterflow rinse system in combination with the barrel rinse tank 70, as heretofore described, that provides the internal rinsing within the barrel while the barrel is positioned in the barrel rinse tank 70.

Figure 8:
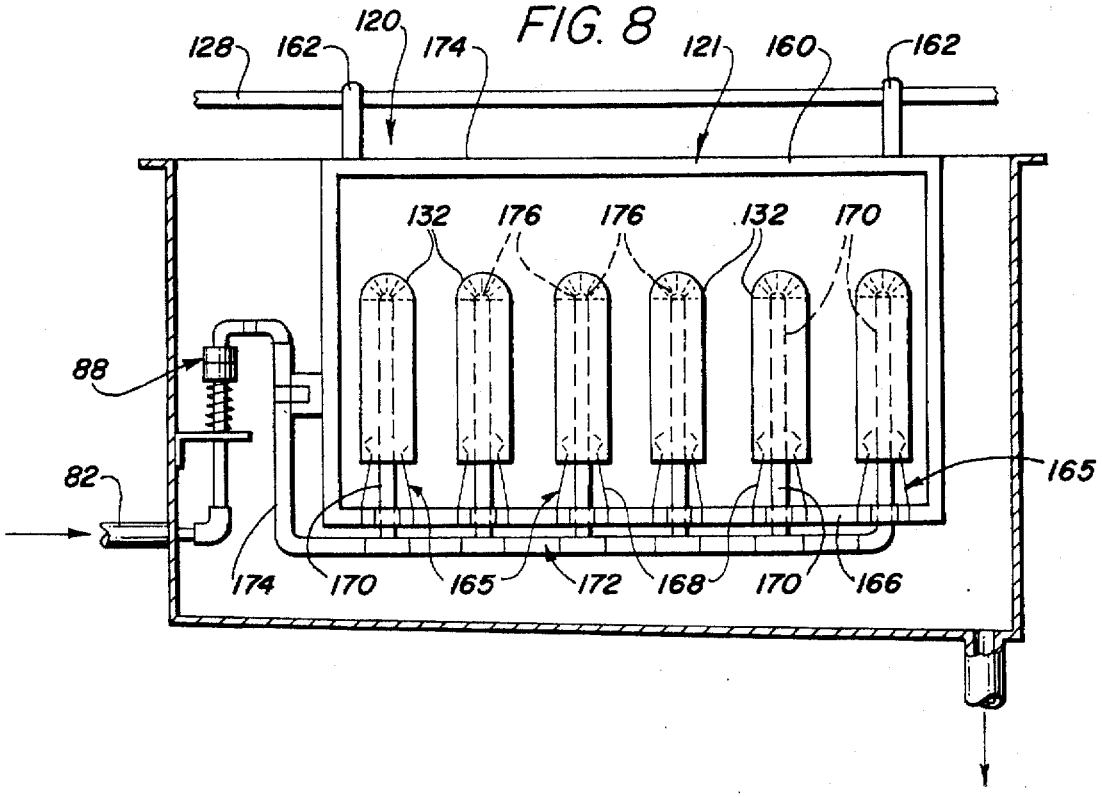
FIG. 8 is a view similar to that of FIG. 7, wherein the second arrangement of the spray rack is shown.

The third embodiment shown in FIGS. 7 and 8 comprises the employment of the multi-spray counterflow rinse system in combination with the multi-spray article support means 120 such as the rack 121, wherein the rack is adapted for use with the barrel rinse tank or a similarly arranged rinse tank which includes the automatic coupling means 88.

What I claim is:

1. An improved multi-spray counterflow apparatus for rinsing chemically treated workpieces, comprising:

a plurality of reservoirs wherein rinse solution is stored;

a single spray-rinse tank arranged to receive said rinse solution during sequential rinse cycles from said respective reservoirs for spray rinsing the workpieces within said spray-rinse tank;

automatic control means whereby rinse cycles are sequentially arranged to spray rinse workpieces within said spray-rinse tank;

means for spraying said workpieces in said spray-rinse tank;

discharge flow means for transferring said rinse solution from said reservoirs to said spray-rinse tank including a manifold having a plurality of inlets and a single outlet;

means for supplying uncontaminated rinse solution for cycling to said spray-rinse tank through one of said inlets of said manifold together with said rinse solution from said reservoirs;

return flow means for returning said rinse solutions from said spray-rinse tank back to selected reservoirs;

means for operating said discharge flow means, said means for supplying uncontaminated rinse solution and said return flow means;

air supply means connected downstream of said outlet of said manifold, whereby continuous air is supplied for pressurizing and purging said spray means of said rinse solutions that remain therein after each rinse cycle;

means for automatically controlling the sequential operation of said discharge flow means, said means for supplying uncontaminated rinse solution and said return flow means.

2. The apparatus as recited in claim 1, wherein said discharge flow means comprises a plurality of discharge valves, each being operably connected to said respective reservoirs and said respective inlets of said manifold, whereby said manifold is interposed between said discharge valves and said spray means, and wherein said means for supplying uncontaminated rinse solution includes a valve connected to one of said inlet ports.

3. The apparatus as recited in claim 2, wherein said return flow means for returning said rinse solution back to said reservoirs comprises:

a plurality of return valves each being connected to a drain means, to said respective reservoirs, and to said spray-rinse tank;

a return pump interposed between said return valves and said spray-rinse tank, whereby said rinse solution is pumped under pressure from said spray-rinse tank and sequentially returned to said rinse tank and to designated reservoirs during a given rinse cycle;

said reservoirs being defined as sealed tanks wherein the rinse solution is subjected to the internal pressure within each of said sealed tanks, whereby the rinse solution is discharged under pressure from each of said sealed tank so as to be transported through said manifold where the solution is again pressurized after entering said spray means.

4. The apparatus as recited in claim 3, wherein said discharge valves, said return valves and said uncontaminated rinse solution valve are pneumatic valves and wherein said pneumatic valves are operated by said air supply means to selectively and sequentially operate a multiplicity of overlapping counterflow spray-rinse cycles.

5. The apparatus as recited in claim 4, wherein said uncontaminated rinse solution consists of fresh water.

6. The apparatus as recited in claim 5, wherein said rinse solution from said reservoirs consists of a chemical compound.

7. The apparatus as recited in claim 2, including means for selectively providing multi-cycling spraying of said uncontaminated rinse solution without using said rinse solution from said reservoirs.

8. An apparatus for spray-rinsing chemically treated workpieces wherein said workpieces are supported within a bulk carrier employing a single spray rinse tank, whereby the least amount of rinse solution is used for removing contaminated residue from the workpieces, wherein said apparatus comprising:

a spray-rinse tank having a spray means mounted therein consisting of at least one inlet spray line;

a plurality of reservoirs having spray-rinse solutions stored therein;

a counterflow means including a discharge flow means and a return flow means to provide a multiplicity of rinse cycles, said discharge flow means being operably connected to said spray-rinse tank, whereby said rinse solution is sprayed in sequential overlapping cycles from said reservoirs into said spray-rinse tank, and wherein said return flow means communicates between said spray-rinse tank and said reservoir, whereby rinse solution from said spray-rinse tank is returned sequentially to said reservoirs in a corresponding overlapping response to the discharging of said rinse solution from said respective reservoirs;

means for supplying a fresh water flow including a fresh water supply valve;

means for pressurizing said reservoir, whereby said rinse solution is transported under pressure through said discharge flow means to said spray-rinse tank;

means for controlling and operating the sequential operation of said discharge flow means, said return flow means, and said fresh water flow means to said spray-rinse tank and said return flow system.

9. An apparatus for spray-rinsing chemically treated workpieces as recited in claim 8, wherein said bulk carrier comprises a processing barrel.

10. An apparatus for spray-rinsing chemically treated workpieces as recited in claim 9, wherein said processing barrel includes:

an internal spray means mounted in said processing barrel for spraying a multiplicity of workpieces supported by said processing barrel; and a coupling means mounted in said rinse tank and to said processing barrel so as to be releasably coupled to said tank spray means mounted within said rinse tank, whereby rinse solution is sprayed into said rinse tank by said tank spray means and through said internal spray means for spraying said solution directly over the contaminated workpieces supported by said processing barrel.

11. An apparatus for spray-rinsing chemically treated workpieces as recited in claim 10, wherein said coupling means comprises a first coupling member and a second coupling member, said first coupling member being mounted to the wall of said rinse tank, and said second coupling member being mounted to the processing barrel and arranged to communicate with said internal spray means of said processing barrel.

12. An apparatus for spray-rinsing chemically treated workpieces as recited in claim 11, wherein said internal spray means comprises at least one spray nozzle internally mounted on one side of said processing barrel.

13. An apparatus for spray-rinsing chemically treated workpieces as recited in claim 11, wherein said internal spray means comprises a pair of spray nozzles internally mounted to the opposite sides of said processing barrel.

14. An apparatus for spray-rinsing chemically treated workpieces as recited in claim 13, wherein said coupling means comprises a first coupling member and a second coupling member, said first coupling member being mounted to the wall of said rinse tank, and said second coupling member being mounted to said support rack and arranged to communicate with said internal spray means of said support rack.

15. An apparatus for spray-rinsing chemically treated workpieces as recited in claim 8, wherein said bulk carrier comprises a support rack for a multiplicity of workpieces.

16. An apparatus for spray-rinsing chemically treated workpieces as recited in claim 15, wherein said support rack includes:

an internal spray means mounted in said support rack for spraying a multiplicity of workpieces supported by said support rack; and a coupling means mounted in said rinse tank and to said support rack so as to be releasably coupled to said tank spray means mounted on said tank, whereby rinse solution is sprayed into said rinse tank by said tank spray means and through said internal spray means for spraying said solution directly over the contaminated workpieces supported by said support rack.

17. An apparatus for spray-rinsing chemically treated workpieces as recited in claim 8, wherein said reservoirs are sealed.

18. An apparatus for spray-rinsing chemically treated workpieces as recited in claim 17, wherein said discharge flow means includes:

a plurality of discharge valves operably connected in sequence so as to communicate with respective reservoirs and said spray means;

a manifold having a plurality of inlets to receive pipes from respective discharge valves and said fresh water supply valve, and an outlet connected to said spray means;

means to continuously provide pressure in the rinse solution flow downstream of said manifold outlet, whereby rinse solution and fresh water pass through said spray means and are sprayed on the workpieces under a given pressure; and means for purging said spray means.

19. An apparatus for spray-rinsing chemically treated workpieces as recited in claim 17, wherein said return flow means comprises:

a plurality of return valves operably connected in sequence so as to communicate with respective reservoirs and said spray-rinse tank;

a return pump interposed between said return valves and said spray-rinse tank;

said return valves and said return pump being operably connected to a control means.

20. An apparatus for spray-rinsing chemically treated workpieces as recited in claim 8, wherein said bulk carrier includes:

a carrier spray means formed on said bulk carrier for spraying a multiplicity of workpieces supported by said carrier;

means for removably mounting said articles on said bulk carrier; and a coupling means mounted in said rinse tank, wherein said bulk carrier is releasably coupled to said tank spray means when positioned in said rinse tank, whereby rinse solution is sprayed into said rinse tank by said tank spray means and through said carrier spray means by way of said coupling means for spraying said solution directly over the contaminated workpieces supported by said bulk carrier.

21. A process for multi-spray counterflow rinsing chemically treat workpieces comprising the steps of:

positioning a single spray rinse tank within a processing line, wherein said multi-spray rinsing apparatus includes a multiplicity of rinse cycles;

positioning at least one workpiece in said spray rinse tank;

storing rinse solution in a multiplicity of pressurized reservoirs;

discharging said rinse solutions from respective pressurized reservoirs through respective pipelines connected to inlets formed in a manifold, and wherein said manifold includes a single outlet downstream thereof;

spraying said rinse solution over said workpiece in said rinse tank in selective predetermined rinse cycles by means of a tank spray apparatus;

spraying uncontaminated rinse solution from a supply means during predetermined rinse cycles;

introducing a continuous air downstream of said single outlet of said manifold, wherein said rinse solutions are sprayed under a pressure over said workpieces;

purging said spray means of all remaining rinse solutions after each rinse cycle by means of said continuous air pressure;

automatically controlling the discharging of said rinse solutions including said uncontaminated rinse solution to establish overlapping sequential rinse cycles.

22. The process as recited in claim 21 including the step of bypassing said discharging of said rinse solutions, whereby all of said rinse cycles contain said uncontaminated rinse solution.

23. The process as recited in claim 21, wherein said uncontaminated rinse solution consists of fresh water.

* * * * *